US009878340B2

(12) United States Patent
Schmon et al.

(10) Patent No.: US 9,878,340 B2
(45) Date of Patent: Jan. 30, 2018

(54) COLOR APPLICATION SYSTEM AND METHOD FOR OPERATING THE SAME

(75) Inventors: Ewald Schmon, Grafenberg (DE); Peter Dettlaff, Remseck (DE)

(73) Assignee: SATA GMBH & CO. KG, Kornwestheim (DE)

( * ) Notice: Subject to any disclaimer, the term of this patent is extended or adjusted under 35 U.S.C. 154(b) by 718 days.

(21) Appl. No.: 13/879,166

(22) PCT Filed: Sep. 26, 2011

(86) PCT No.: PCT/EP2011/066665

§ 371 (c)(1),
(2), (4) Date: Jun. 28, 2013

(87) PCT Pub. No.: WO2012/052255

PCT Pub. Date: Apr. 26, 2012

(65) Prior Publication Data

US 2014/0145003 A1 May 29, 2014

(30) Foreign Application Priority Data

Oct. 20, 2010 (DE) ..... 10 2010 060 086

(51) Int. Cl.
*B05B 12/00* (2006.01)
*B05B 7/24* (2006.01)
(Continued)

(52) U.S. Cl.
CPC ..... *B05B 12/008* (2013.01); *B05B 7/2478* (2013.01); *B05B 12/12* (2013.01); *B05B 7/02* (2013.01); *B05B 15/12* (2013.01)

(58) Field of Classification Search
CPC ..... B05B 12/12; B05B 12/008; B05B 7/02; B05B 15/12–15/1296; B05B 7/2478
(Continued)

(56) References Cited

U.S. PATENT DOCUMENTS 4,614,300 A 9/1986 Falcoff
5,191,797 A * 3/1993 Smith ..... B05B 12/008 116/34 R
(Continued)

FOREIGN PATENT DOCUMENTS

DE 3402945 A1 8/1985
DE 69535077 T2 11/2006
(Continued)

OTHER PUBLICATIONS

International Search Report (ISR) dated Jan. 23, 2012 for International Patent Application No. PCT/EP2011/066665.
(Continued)

*Primary Examiner* — Arthur O Hall
*Assistant Examiner* — Juan C Barrera
(74) *Attorney, Agent, or Firm* — Paul D. Bianco; Katharine Davis; Fleit Gibbons Gutman Bongini & Bianco PL

(57) ABSTRACT

A color application system and method provide improved results of the color application and the operation of the color application system, for example color application errors due to varying pressure are reduced or eliminated, by using a color application system having one or more receivers for wireless data transfer between components of the color application system, wherein one of the components is a color sprayer having a detecting unit for detecting operating parameters of the color sprayer and/or environmental parameters, and a transmitter for wirelessly transferring the operating parameters and/or environmental parameters to the receiver. In a method for operating such a color application system, the operating parameters of spray air pressure and/or optionally the pressure of the medium to be sprayed is detected in or at the color sprayer, and then the detected
(Continued)

pressure or pressures are wirelessly transferred to one or more components of the color application system.

25 Claims, 5 Drawing Sheets

(51) Int. Cl.
*B05B 12/12* (2006.01)
*B05B 7/02* (2006.01)
*B05B 15/12* (2006.01)

(58) Field of Classification Search
USPC ..... 239/8, 291, 300
See application file for complete search history.

(56) References Cited

U.S. PATENT DOCUMENTS 5,381,962 A * 1/1995 Teague ..... B05B 12/00 239/525
5,443,642 A * 8/1995 Bienduga ..... B05B 5/08 118/623
5,718,767 A * 2/1998 Crum ..... G05B 19/4148 118/314
5,843,515 A 12/1998 Crum et al.
6,017,394 A 1/2000 Crum et al.
6,132,511 A 10/2000 Crum et al.
6,328,233 B1 * 12/2001 Moy ..... B05B 7/0012 239/302
6,547,884 B1 4/2003 Crum et al.
6,661,438 B1 12/2003 Shiraishi et al.
6,766,763 B2 7/2004 Crum et al.
6,863,920 B2 3/2005 Crum et al.
7,422,164 B2 9/2008 Matsumoto
7,509,864 B2 * 3/2009 Charpie ..... B05B 7/2416 239/346
8,037,844 B2 10/2011 Mather et al.
8,242,901 B2 8/2012 Indefrey et al.
8,578,878 B2 11/2013 Khoury et al.
8,584,973 B2 11/2013 Mather et al.
8,916,241 B2 12/2014 Khoury et al.
2003/0177979 A1 9/2003 Crum et al.
2004/0191406 A1 9/2004 Crum et al.
2005/0127201 A1 6/2005 Matsumoto
2007/0017443 A1 1/2007 Skelton-Becker et al.
2009/0110803 A1 * 4/2009 Mather ..... B05B 5/032 427/8
2009/0110839 A1 4/2009 Mather et al.
2009/0235864 A1 * 9/2009 Khoury ..... B05B 12/008 118/668
2012/0009329 A1 1/2012 Mather et al.
2014/0042238 A1 2/2014 Mather et al.
2014/0087061 A1 3/2014 Khoury et al.
2015/0109144 A1 4/2015 Khoury et al.

FOREIGN PATENT DOCUMENTS

EP 1477232 11/2004
EP 1477232 A1 11/2004
EP 1504823 2/2005
EP 1504823 A1 2/2005
EP 1965482 A1 9/2008
EP 2055391 5/2009
EP 2241378 10/2010
GB 2153260 8/1985
JP H0739794 2/1995
JP H10245849 9/1998
JP 2000-85864 3/2000
JP 2003211034 7/2003
JP 2004041583 2/2004
JP 2005052830 3/2005
JP 2005212957 8/2005
JP 2007502703 2/2007
JP 2008-210384 A 9/2008
JP 2009136860 6/2009
JP 2009-536572 10/2009
WO 2005/018825 3/2005
WO 2007/133386 11/2007
WO 2007133386 A2 11/2007

OTHER PUBLICATIONS

Written Opinion, dated Jan. 2012, for International Patent Application No. PCT/EP2011/066665.
International Preliminary Report published Apr. 23 2013 for PCT/EP2011/066665.
Japanese Office Action for Application No. 2016-163776 dated Jul. 13, 2017.

* cited by examiner

COLOR APPLICATION SYSTEM AND METHOD FOR OPERATING THE SAME

FIELD OF THE INVENTION

The invention concerns a color application system and a method for operating the same.

BACKGROUND OF THE INVENTION

From DE 695 35 077 T2, a control system for a powder coating system is known. There, a communication network is provided, which connects control components of the powder coating system with powder sprayers, which spray powder coating materials on parts that are to be coated. The disadvantage there is that there is no monitoring of the pressure of the powder to be applied on the powder sprayers, but rather, the pressure is merely measured and adjusted, at a relatively far distance from the powder sprayers. A pressure fluctuation on the powder sprayers is, therefore, recognized only late and any application errors produced in this way are compensated for only poorly. In addition, in such a system, leakages in the supply lines or a clogging are not detected; an insufficient coating result is attained due to a decrease or increase in pressure. The long lines before the adjusting and measuring elements to the sprayer lead to inaccurate and delayed regulations and adjustments as a result of the relatively high volumes.

U.S. Pat. No. 5,443,642 concerns a system for electrostatic color coating, wherein the pressure there is measured via pressure sensors and the air humidity, via humidity sensors, which, however, are not directly located on a color sprayer. Rather, permanently installed spray heads are used there, with the workpiece moving past them.

Another electrostatic sprayer can be deduced from DE 34 02 945 C2, which has on it a voltage display with a display field pointing backwards. Dependent on the voltage on the sprayer, a light-emitting diode shines, so that changes in the voltage can be quickly detected.

Since, in contrast to powder coating systems with color sprayers and lacquer spray guns for liquid colors, the quality of the color application is decisively dependent on the atomization and thus on the pressure directly applied on the sprayer nozzle, the known powder coating system does not offer a sufficiently good solution for fluid-operated color sprayers. In particular, it is not possible there to measure directly the pressure on the sprayers and thus to promptly regulate them.

With known color sprayers or lacquer spray guns, in particular, for liquid media, such as paint, digital pressure measuring devices are used in the sprayer, wherein the tracking of the pressure on the color sprayer takes place either via manually adjustable throttles or via pressure regulators, which are located at a distance from the color sprayer. In order to change the pressure applied on the color sprayer, the pressure must be readjusted, via the throttle or the pressure regulator, until the desired pressure on the color sprayer is attained. This is susceptible to error, in particular if the environmental conditions change, for example, the pressure hose to the color sprayer is bent or has constrictions; the position of the color sprayer changes during the application of the color; other consumers are connected or disconnected, etc. The application result is influenced negatively by the pressure changes which thereby occur.

U.S. Pat. No. 5,381,962 discloses an example of such a color application system in the form of a sprayer and the transmitter located therein, for the wireless data transfer, with a receiver of a pump module. There, adjustments on the color sprayer can be undertaken with the aid of switches on the sprayer; these can then be transferred to the pump module. Thus, the pump module can be operated from the color sprayer, wherein this must always take place manually—that is, in a relatively slow and inaccurate manner.

Also, U.S. Pat. No. 4,614,300, which concerns an automatic color application system, merely discloses that a control and supply of mechanically moveable sprayers takes place. Data on the sprayers are neither detected nor sent back from there to the control of the color application system.

SUMMARY OF THE INVENTION

Therefore, the goal of the invention is to create a color application system and a method for its operation, in which the color application result and the operation of the color application system is improved and, in particular, color application errors caused by pressure fluctuations are reduced or entirely avoided.

This goal is obtained by the invention with a color application system and a method for its operation. Advantageous developments and expedient refinements of the invention are also disclosed herein.

In this regard, the invention provides for a color application system with one or more receivers for wireless data transfer between components of the color application system, wherein one of the components is a color sprayer with a detection unit for the detection of operating parameters of the color sprayer and/or environmental parameters and a transmitter for the wireless transfer of the operating parameters and/or the environmental parameters to the receiver.

Furthermore, in this respect, the invention provides for a method for the operation of such a color application system, wherein the operating parameter spray air pressure and/or the pressure of the medium to be sprayed is detected on or in the color sprayer, and then, the detected pressure(s) or other operating or environmental parameters are transferred wirelessly to one or more components of the color application system.

In a preferred development of the invention, the transmitter of the color sprayer can be integrated, encapsulated, into the color sprayer. In this way, a penetration of the medium to be sprayed, as well as cleaning agents and solvents, into the sensitive electronics of the detection unit and the transmitter can be avoided. An integrated or encapsulated transmitter 102 is shown with color sprayer 2 in FIG. 2.

In addition, the detection unit in or on the color sprayer can comprise one or more pressure detection devices for the detection of the operating parameters spray air pressure and/or the pressure of the medium to be sprayed and, optionally, other parameters. In this way, the pertinent pressure can be determined directly before the application site and then any deviation from the desired pressure or other parameters can be quickly readjusted, without the user having to activate the color sprayer. This is particularly advantageous in the case of only small pressure fluctuations, for example, by a brief position change of the sprayer or a bending or constricting of the supply hose for the spray compressed air or the medium to be applied.

Advantageously, the detection unit can comprise on or more measuring devices for the detection of the environmental parameters air pressure, air humidity, air speed, and/or ambient temperature, etc. In this way, it is possible to take into consideration such environmental parameters during the adjustment of the spray air pressure and/or the pressure of the medium to be applied, as well as other parameters.

Moreover, the color sprayer can be advantageously connected with a component of the color application system, designed as a compressed air provision, with a compressed air source and a compressed air regulator, for supplying with spray compressed air via a compressed air line. Thus, the detected spray air pressure can advantageously be transferred to the compressed air regulator of the compressed air supply and be compared there with a prespecified theoretical value of the spray air pressure, and the compressed air regulator can then adjust the pressure of the spray compressed air delivered to the color sprayer in such a way that the spray air pressure on the color sprayer is adapted to the theoretical value of the spray air pressure.

Likewise, additionally or alternatively, the color sprayer can be advantageously connected with a component of the color application system, designed as a medium supply, for provision with the medium to be sprayed via a medium supply line. In this way, the detected pressure of the medium to be sprayed can be advantageously transferred to the medium supply and there, compared with a prespecified theoretical value, and the medium supply can then adjust the pressure of the medium delivered to the color sprayer in such a way that the pressure of the medium to be sprayed on the color sprayer is adapted to the theoretical value.

In another advantageous development of the invention, the color application system can comprise, as an additional component, a control for the monitoring and/or control of the operating parameters of the color sprayer and other components of the color application system. Thus the detected pressure(s) can be advantageously transferred to the control; the detected pressure is compared, in the control, with a prespecified theoretical value of this pressure; and the control then manages the compressed air regulator and/or the medium provision in such a way that the pressure of the spray compressed air and/or the medium to be sprayed on the color sprayer is advantageously adapted to the prespecified theoretical value.

In an advantageous, user-friendly embodiment, a display unit to indicate the operating parameters and/or the environmental parameters, detected by the detection unit, is provided as an additional component of the color application system. With this, the detected operating parameters and/or environmental parameters, and in particular, the detected pressure(s) is/are transferred to the display unit so they can be indicated. In another development, an indication can be shown on the display unit, if a prespecified value for the spray air pressure and/or the pressure of the medium to be sprayed, adjusted on the color sprayer or the operating unit, exceeds or falls short of the maximum pressure that can be made available. In this way, the user of the color sprayer can quickly be made aware when the pressure was not automatically adjusted or insufficient operating conditions prevail.

Preferably, the display unit can be placed on the site of the medium application, in particular, in a spray booth. Alternatively, the display unit can be located on the color sprayer. Display unit 9 is shown located on color sprayer 2 in FIG. 3. In addition, alternatively, the display unit can be transportable, and in particular, it can be designed in the form of a display unit that can be affixed to the wrist of an operator of the color sprayer. Display unit 9 is shown affixed to the wrist of an operator in FIG. 4. It is also conceivable to equip a traditional wristwatch or pocket watch with such a display unit as an additional function. All these variants have the advantage that the user can recall the indicated data, quickly and directly, during the application and not have to go to a remote place, as with known devices in which a display, in particular, of pressure parameters regularly takes place at the pressure supply or control that is more or less far removed from the application site.

In an advantageous refinement, the color application system can comprise, as an additional component, an operating unit for the modification of adjustment parameters of the color application system. The operating unit can be advantageously located, just like the display unit, on the color sprayer. Operating unit 7 is shown located on color sprayer 2 in FIG. 3. In addition, alternatively, the operating unit can be can transportable, just like the display unit, and in particular, it can be designed in the form of an operating unit that can be affixed on the wrist of an operator of the color sprayer. Operating unit 7 is shown affixed to the wrist of an operator in FIG. 4. All these variants have the advantage that the user can modify and control adjustment parameters which have to be modified, for example, the desired spray air pressure, in a quick and direct manner, at the site of color application, optionally even during the application itself, and he does not have to go to a remote place, as with known devices in which an operation is often possible only there.

Preferably, one or more of the components can have a receiver and/or transmitter for the wireless transmission of data. In this way, these components can advantageously transfer data directly to one another, so that, for example, a breakdown or error in the compressed air supply can be transferred directly to the display unit on the wrist of the user of the color sprayer and can trigger an alarm there, acoustically and/or visually. Furthermore, the wireless data transfer can be advantageously carried out bidirectionally, so that with a just described alarm with the user, he can directly send out, via an operating unit, a signal to the defective compressed air supply, for example, a stop signal for the immediate turning off of the compressed air supply.

Advantageously, the wireless data transfer can take place via radio, WLAN, DECT or Bluetooth, or other such media, so that already known, standardized transmitters and receivers can be used.

BRIEF DESCRIPTION OF THE DRAWINGS

Other special features and advantages of the invention can be deduce from the following description of a preferred embodiment example with the aid of the drawing in FIG. 1

DETAILED DESCRIPTION OF THE INVENTION

Figure 1:
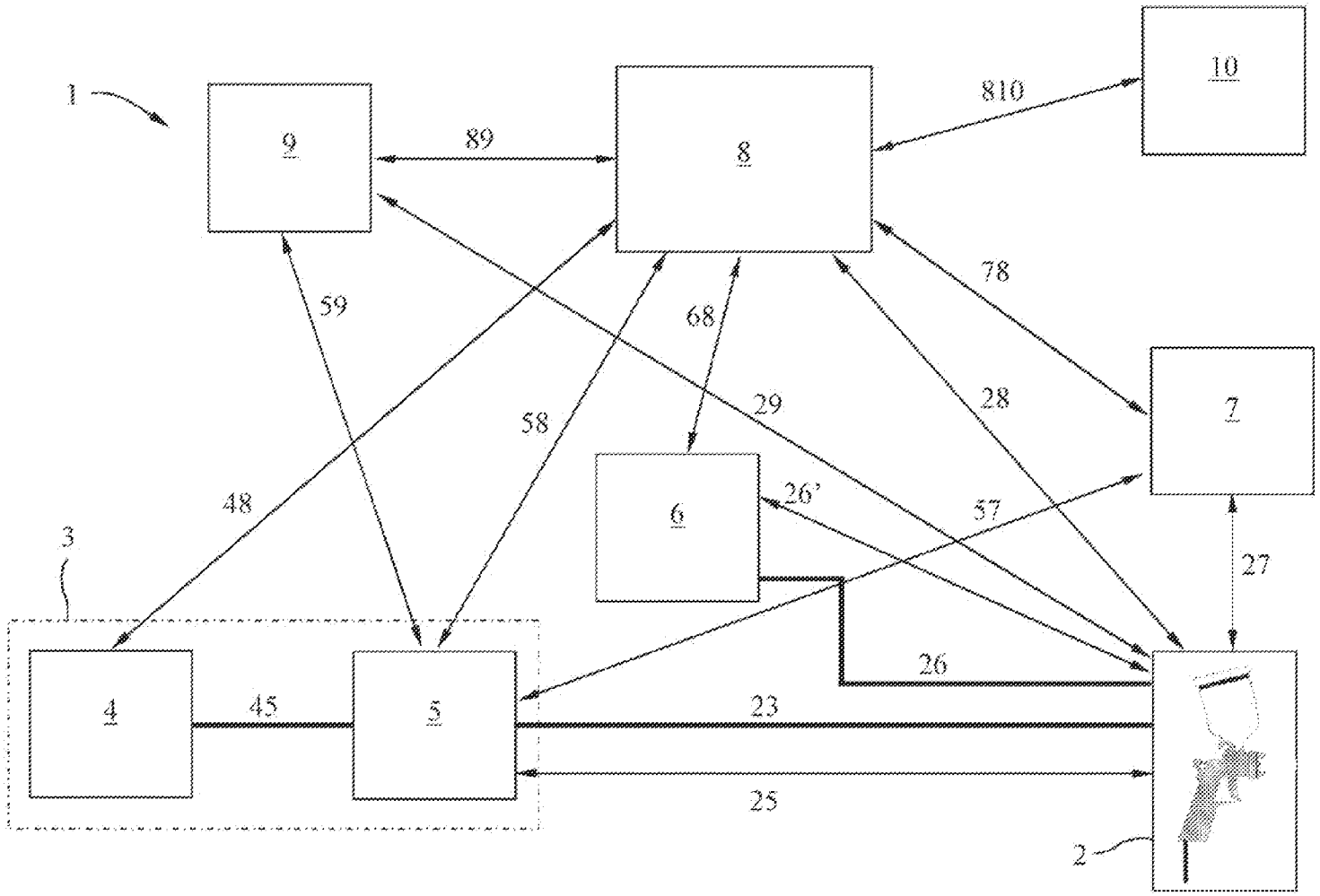

FIG. 1 shows a functional block diagram of a color application system 1, in accordance with the invention. In order to apply, as a medium, liquid color or lacquer on an object to be sprinkled or sprayed, a color sprayer 2, which is, in fact, known, with a pressure sensor, located in the color sprayer 2, preferably a digital pressure sensor as the detection unit for the operating parameters, spray air pressure and/or the pressure of the medium to be sprinkled or sprayed, is provided. In addition, the color sprayer 2 comprises a WLAN transmitter and a data processing unit, which prepares the detected operating parameters for the data transfer to the WLAN transmitter.

Figure 2:
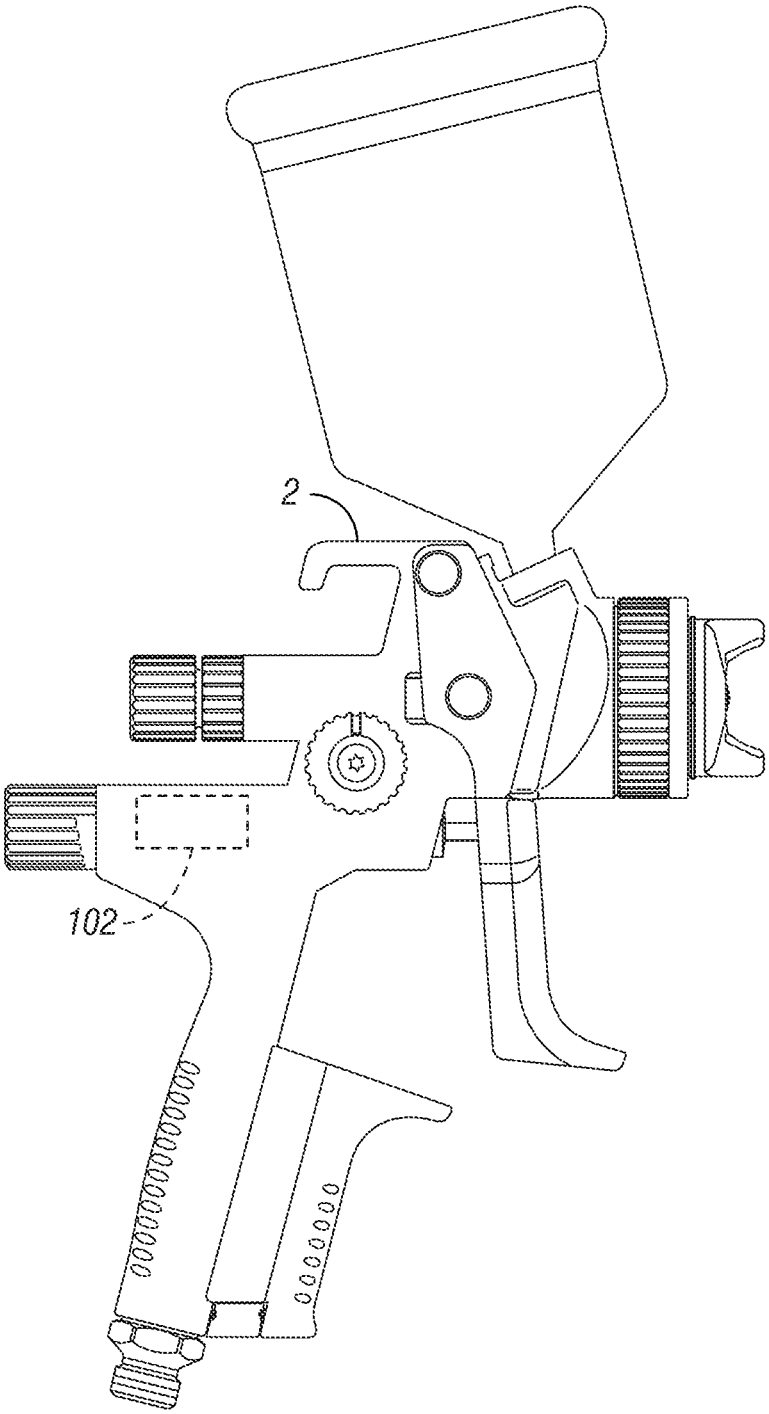

FIG. 2 shows a side view of the color sprayer of the color application system having an integrated or encapsulated transmitter.

Figure 3:
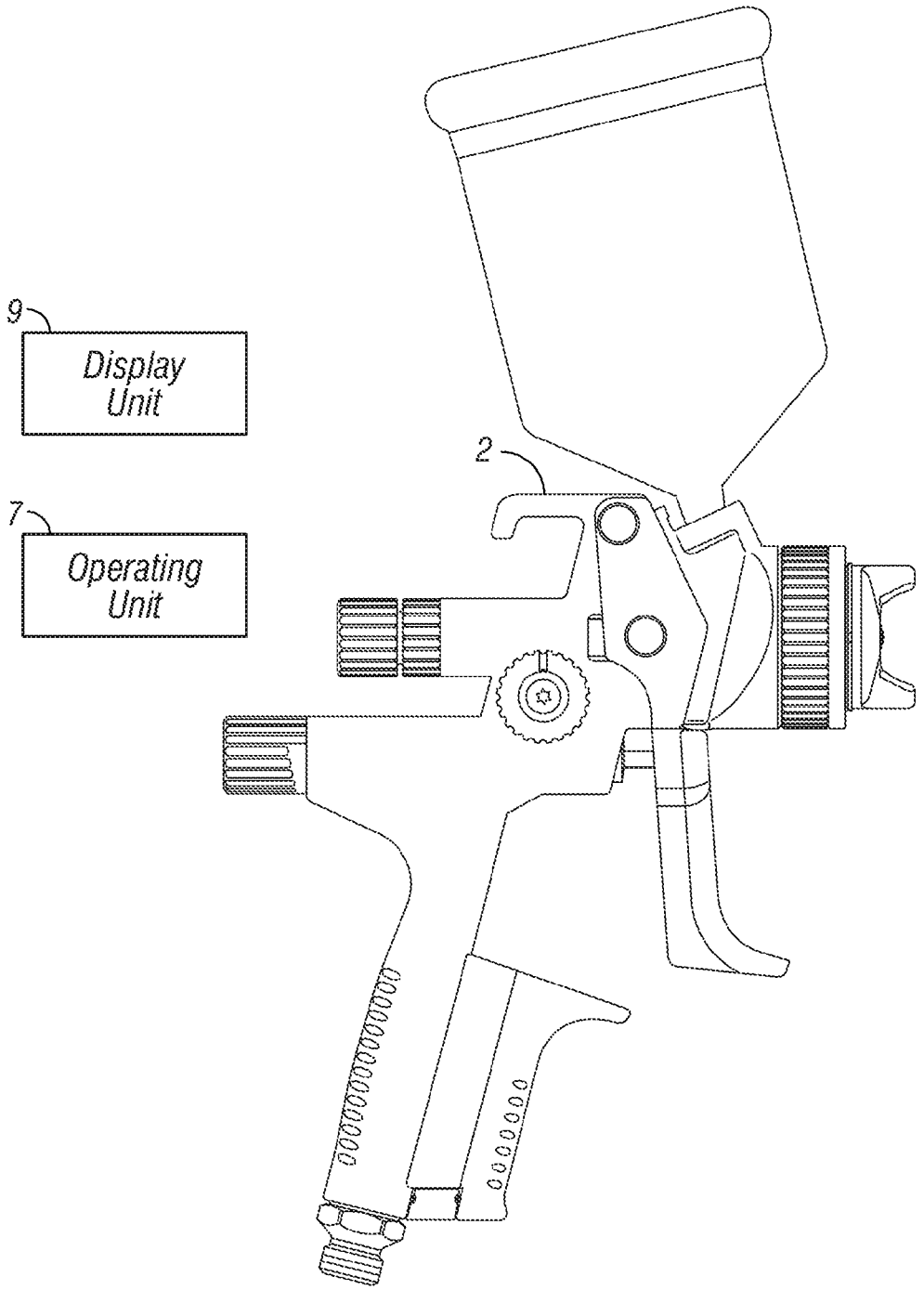

FIG. 3 shows a side view of the color sprayer of the color application system having a display unit and an operating unit located thereon.

Figure 4:
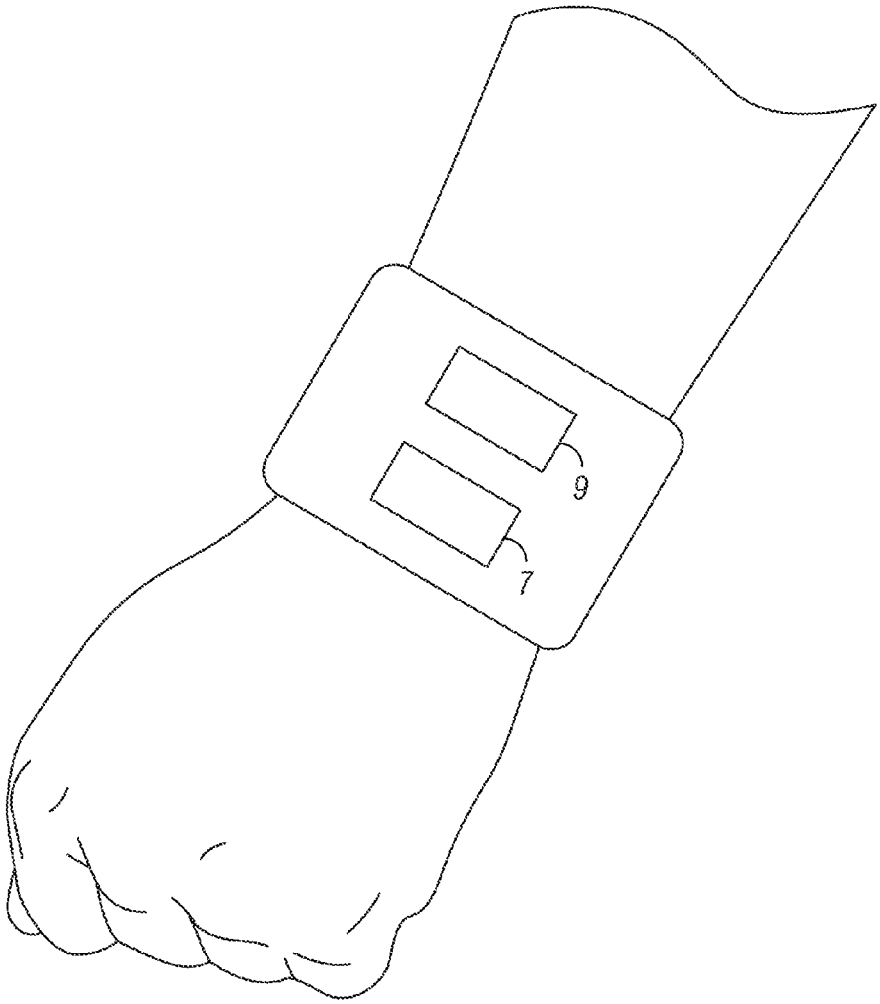

FIG. 4 shows a top of a transportable device for operation of the color application system having a display unit and an operating unit located thereon.

Figure 5:
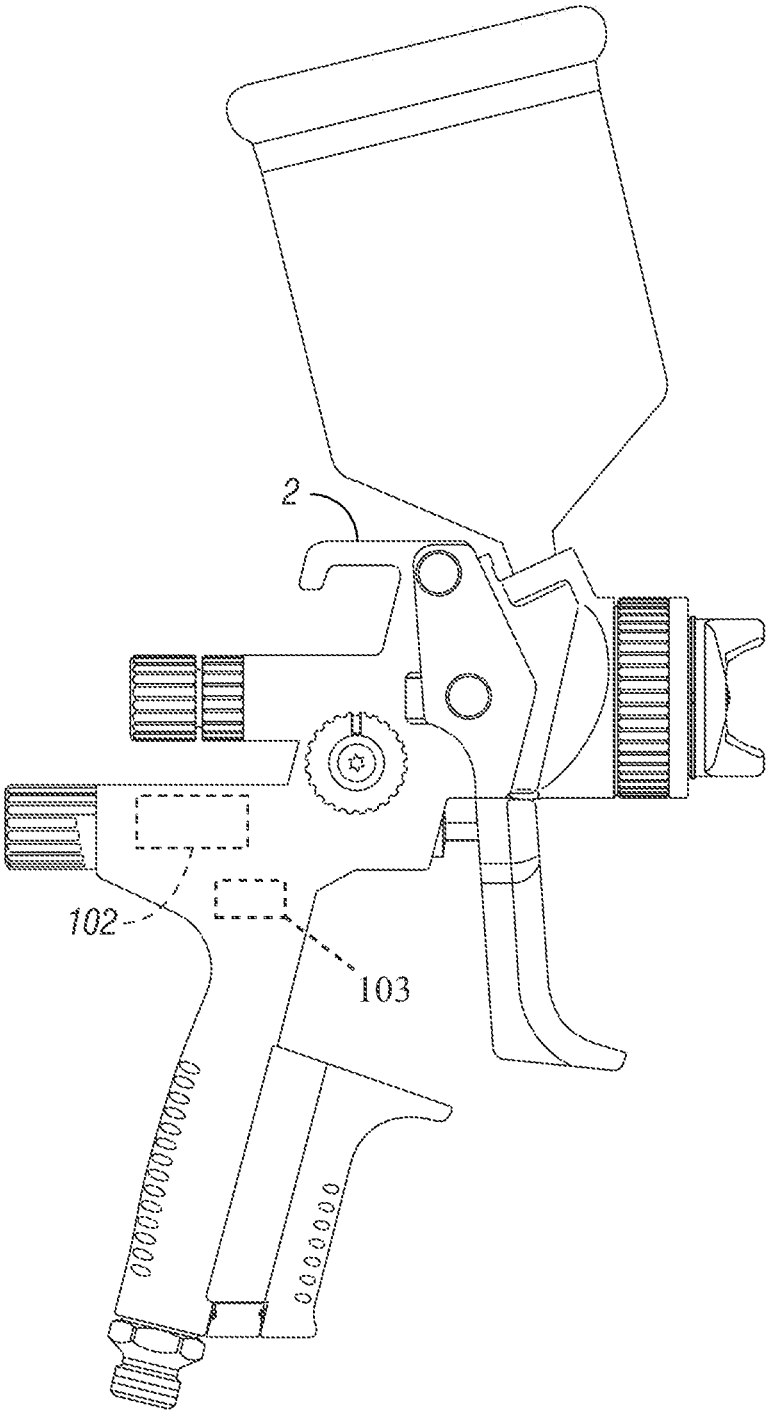

FIG. 5 shows a side view of the color sprayer of the color application system having a detecting unit containing a measuring device.

The color sprayer 2 is supplied, via a connection line 23, drawn thick, with spray compressed air—below, referred to also as compressed air—from a compressed air provision 3 (optionally also with compressed air preparation). In this respect, the compressed air provision 3 has a pressure source 4 and a pressure regulator 5. By means of the pressure regulator 5, it is possible to adjust the pressure in the connection line 23 to the color sprayer 2. In addition, the transmitter communicates with the pressure regulator 5 via a WLAN connection 25.

Here and below, thick connection lines mark conveyance lines, whereas the double arrows, drawn thin in FIG. 1, refer to the data communication.

Furthermore, the color sprayer 2 is connected, via a material supply line 26, with a medium provision for the liquid coating material, designed as a conveyance unit 6. On the other hand, the medium (the color or the lacquer) could also come via gravity, (overhead), suspension, or side cups into the color sprayer.

The color application system 1 is centrally controlled by a control unit 8, which, with all other depicted components of the color application system 1, is connected with WLAN connections to the wireless data transfer. Of course, other such connections can also be provided.

Another component of the color application system 1 is an operating unit 7, which is designed as a wrist computer as shown in FIG. 4. It can also be designed, however, as a transportable computer, which can be carried by the operator directly on his body or can be located in the vicinity of the site where the color is applied. Alternatively, the operating unit 7 can also be a remote service unit.

In addition, a display unit 9 is provided, which shows all essential data for the color spraying, for example, the values adjusted on the pressure provision 3 and/or the medium provision 6 and actually applied- also the detected operating parameters transferred by the color sprayer 2 , etc. In this case, the display unit 9 is advantageously integrated with the operating unit 7 in the manual computer. However, it can also be situated in a stationary manner or it can be designed as a transportable display unit. Display unit 9 is shown located on color sprayer 2 in FIG. 3 and on the wrist of an operator in FIG. 4.

Here, the data communication is carried out completely via wireless WLAN connections, but it could also be operated via other suitable wireless connections, for example, Bluetooth. In addition, a combination of different connection possibilities, both wireless as well as cable-supported connections, are possible. However, it is advantageous if at least the color sprayer, the operating unit 7, and the display unit 9 communicate wirelessly with one another or with other components, in particular, the control unit 8.

A spray booth 10, in which the color application is carried out here with the color sprayer, is also connected with the control unit 8.

Particularly when using the color sprayer 2 in the spray booth 10, a wireless data transfer is advantageous, since then only the supply lines 23 and 26 for the spray compressed air and color have to be provided, whereas other connection lines for the transfer of data can be omitted.

As a result of these wireless connections with transmitting performances below the explosion limit values, a very high operating safety is guaranteed in the spray booth, which, as a rule, is constructed as an explosion-proof space. The expense for sufficient explosion protection measures is, in any case, reduced.

Moreover, in a preferred embodiment, the adjustment elements for the spray air pressure and/or optionally, the color pressure can be located on the color sprayer 2 itself or on the operating unit 7.

In the conveying unit 6, furthermore, sensors for the detection of the decisive conveyance data, for example, updated pressure, made available by the conveyance unit, a throughflow quantity of the conveyed material, etc., can be provided, which can transfer these and optionally other measurement parameters to the control unit 8 and/or the display unit 9.

Still other sensors are advantageously provided in the detection unit 103 in the color sprayer 2, which can detect the humidity, temperature, and/or air speed in the surroundings of the color sprayer 2. In addition, in an alternative embodiment, the display unit 9 can be located directly on the color sprayer 2 so as to be able to indicate the operating, environmental, and/or the adjustment parameters shown in the display unit 9 to the user of the color sprayer 2. Alternatively or additionally, the parameters detected by the color sprayer 2 or its sensors can also be transferred to the display unit 9, the control unit 8, or the operating unit 7, where they are then clearly visible to the user.

Another advantage of the contactless transfer of data by the color sprayer 2 to the other components 3-10 of the color application system is that, in this way, implementations in the color sprayer 2, for example, to switches, external antennae, or externally running cables can be avoided. This is advantageous, since these sealings must, as a rule, be constructed solvent- and water-tight and, in addition, can easily suffer mechanical damage. This expense can be avoided by the use of the invention. Furthermore, as a result of the wireless data transfer—as already mentioned previously, the invention can be advantageously used, when utilizing the color sprayer 2, under complicated environmental conditions, for example, in areas endangered by explosions or under dusty conditions.

The invention claimed is:

1. A color application system configured for wireless data transfer between components thereof, the color application system comprising:

a color sprayer having a detection unit integrated therein for detecting operating parameters of the color sprayer, the color sprayer configured as a handheld gun for manual operation;

a compressed air provision connected to the color sprayer by a compressed air line, the compressed air provision having a compressed air source and a compressed air regulator for provisioning of compressed air spray;

a medium supply for providing a medium to be sprayed connected to the color sprayer by a medium supply line, the medium supply formed as at least one cup attached to a portion of the color sprayer;

a measurement device contained within the detection unit for detecting pressure of the compressed air spray at the color sprayer;

a measurement device contained within the detection unit for detecting pressure of the medium to be sprayed at the color sprayer;

one or more measurement devices contained within the detection unit for detecting one or more environmental parameters selected from air pressure, air humidity, air speed, and temperature;

a receiver contained within the compressed air provision, the receiver for wireless data transfer between the color sprayer and other components of the color application system; and a transmitter for wireless data transfer of detected parameters to the receiver;

wherein the receiver and the transmitter are configured and arranged for transferring a detected spray air pressure to the compressed air regulator of the compressed air provision, comparing the detected spray air pressure with a pre-specified theoretical value of spray air pressure, adjusting the detected spray air pressure to adapt to the pre-specified theoretical value of spray air pressure, and transferring the adjusted spray air pressure to the color sprayer; and wherein the color application system is configured such that the compressed air spray and the medium to be sprayed are not mixed prior to the compressed air spray entering the color sprayer.

2. The color application system according to claim 1, wherein the other components of the color application system include one or more of a controller, a display unit, an operating unit, and a spray booth.

3. The color application system according to claim 2, wherein the controller is configured and arranged for monitoring and controlling the operating parameters of the color sprayer and the other components of the color application system.

4. The color application system according to claim 2, wherein the display unit is configured and arranged for displaying the detected parameters and the operating unit is configured and arranged for modifying adjustment parameters.

5. The color application system according to claim 4, wherein the display unit and the operating unit are located in the spray booth or at another site of medium application.

6. The color application system according to claim 4, wherein the display unit and the operating unit are located on the color sprayer.

7. The color application system according to claim 4, wherein the display unit and the operating unit are configured to be transportable.

8. The color application system according to claim 7, wherein the display unit and the operating unit are affixable to a wrist of an operator of the color sprayer.

9. The color application system according to claim 1, wherein the transmitter is integrated or encapsulated within the color sprayer.

10. The color application system according to claim 1, wherein the color sprayer is configured and arranged to spray medium by gravity, suspension, through a cup or cups, or through a hose line or hose lines.

11. The color application system according to claim 1, wherein the receiver and the transmitter are configured for transferring data directly to one another.

12. The color application system according to claim 1, wherein the color application system is configured for radio, WLAN, optical, or Bluetooth wireless data transfer between components.

13. The color application system according to claim 1, wherein the color application system is configured for bidirectional wireless data transfer between components.

14. The color application system according to claim 1, wherein the components are arranged such that medium exiting the medium supply line at the color sprayer is sprayed out using compressed air exiting the compressed air line.

15. The color application system according to claim 1, wherein the medium supply formed as at least one cup is attached to a top portion of the color sprayer, to a bottom portion of the color sprayer, or to at least one side portion of the color sprayer.

16. A color application system configured for wireless data transfer between components thereof, the color application system comprising:

a color sprayer having a detection unit integrated therein for detecting operating parameters of the color sprayer;

a compressed air provision connected to the color sprayer by a compressed air line, the compressed air provision having a compressed air source and a compressed air regulator for provisioning of compressed air spray;

a medium supply for providing a medium to be sprayed connected to the color sprayer by a medium supply line, the medium supply formed as at least one cup attached to a portion of the color sprayer;

a measurement device contained within the detection unit for detecting pressure of a compressed air spray to be sprayed at the color sprayer;

a measurement device contained within the detection unit for detecting pressure of a medium to be sprayed at the color sprayer;

one or more measurement devices contained within the detection unit for detecting one or more environmental parameters selected from environmental parameters, air pressure, air humidity, air speed, and environmental temperature;

a display unit located on the color sprayer, the display unit configured and arranged for displaying detected parameters;

an operating unit located on the color sprayer, the operating unit configured and arranged for modifying adjustment parameters;

a receiver contained within the compressed air provision, the receiver for wireless data transfer between the color sprayer and other components of the color application system; and a transmitter integrated or encapsulated within the color sprayer, the transmitter for wireless transfer of detected parameters to the receiver;

wherein the receiver and the transmitter are configured and arranged for transferring a detected spray air pressure to the compressed air regulator of the compressed air provision, comparing the detected spray air pressure with a pre-specified theoretical value of spray air pressure, adjusting the detected spray air pressure to adapt to the pre-specified theoretical value of spray air pressure, and transferring the adjusted spray air pressure to the color sprayer; and wherein the color application system is configured such that the compressed air spray and the medium to be sprayed are not mixed prior to the compressed air spray entering the color sprayer.

17. The color application system according to claim 16, wherein the medium supply formed as at least one cup is attached to a top portion of the color sprayer, to a bottom portion of the color sprayer, or to at least one side portion of the color sprayer.

18. A method for manually operating a color application system, the method comprising:

detecting operating parameters of a color sprayer, the color sprayer configured as a handheld gun for manual operation;

detecting spray air pressure of compressed air supplied to the color sprayer;

detecting pressure of a medium to be sprayed from the color sprayer;

wirelessly transferring the detected operating parameters of the color sprayer, the detected spray air pressure, and the detected pressure of the medium to one or more components of the color application system via a transmitter, the one or more components including the color sprayer, compressed air provisions, a medium supply formed as at least one cup attached to a portion of the color sprayer, a controller, a display unit, an operating unit, and a spray booth; and mixing the compressed air and the medium to be sprayed;

wherein a receiver for receiving the detected spray air pressure is contained within the compressed air provisions.

19. The method according to claim 18, further comprising displaying the detected operating parameters of the color sprayer, the detected spray air pressure, and the detected pressure of the medium on the display unit.

20. The method according to claim 18, further comprising:

transferring the detected spray air pressure to a compressed air regulator of the compressed air provisions;

comparing the detected spray air pressure with a pre-specified theoretical value of spray air pressure;

adjusting the detected spray air pressure to adapt to the pre-specified theoretical value of spray air pressure; and transferring the adjusted spray air pressure to the color sprayer.

21. The method according to claim 20, further comprising monitoring the detected spray air pressure, the pre-specified theoretical value of spray air pressure, and the adjusted spray air pressure, wherein if any of the monitored pressures exceeds a maximum pressure of the color application system, displaying an indication of exceeded pressure on the display unit.

22. The method according to claim 18, further comprising:

transferring the detected spray air pressure to the controller;

comparing the detected spray air pressure with a pre-specified theoretical value of spray air pressure;

using the controller to adjust the detected spray air pressure to adapt to the pre-specified theoretical value of spray air pressure; and transferring the adjusted spray air pressure from the controller to a compressed air regulator of the compressed air provisions.

23. The method according to claim 18, further comprising:

transferring the detected pressure of the medium to the medium supply;

comparing the detected pressure of the medium with a pre-specified theoretical value of pressure of a medium;

adjusting the detected pressure of the medium to adapt to the pre-specified theoretical value of pressure of a medium; and transferring the adjusted pressure of a medium to either or both of the medium supply and the color sprayer.

24. The method according to claim 23, further comprising monitoring the detected pressure of the medium, the pre-specified theoretical value of pressure of a medium, and the adjusted pressure of the medium, wherein if any of the monitored pressures exceeds a maximum pressure of the color application system, displaying an indication of exceeded pressure on the display unit.

25. The method according to claim 18, further comprising:

transferring the detected pressure of the medium to the controller;

comparing the detected pressure of the medium with a pre-specified theoretical value of pressure of a medium;

using the controller to adjust the detected pressure of the medium to adapt to the pre-specified theoretical value of pressure of a medium; and transferring the adjusted pressure of the medium from the controller to either or both of the medium supply and the color sprayer.

* * * * *